United States Patent [19]

Pitel et al.

[11] 3,990,754

[45] Nov. 9, 1976

[54] MERCHANDISING MACHINE CABINET AND SHELF STRUCTURE

[75] Inventors: Irving Pitel, Edison; Richard S. Silverman, Springfield; Richard J. Mueller, Mountain Lakes, all of N.J.

[73] Assignee: Rowe International Inc., Whippany, N.J.

[22] Filed: Jan. 15, 1975

[21] Appl. No.: 541,284

Related U.S. Application Data

[62] Division of Ser. No. 454,118, March 25, 1974.

[52] U.S. Cl. ..... 312/35; 312/223; 312/291; 312/319; 312/323

[51] Int. Cl.[2] ..... A47B 88/06; A47B 96/16; A47F 3/02; A47F 3/06

[58] Field of Search ..... 221/75, 85; 312/35, 312/223, 291, 294, 295, 311, 319, 320, 322, 323

[56] References Cited

UNITED STATES PATENTS

| | | | |
|---|---|---|---|
| 359,451 | 3/1887 | Lang | 312/323 |
| 516,293 | 3/1894 | Beretta | 312/319 X |
| 729,180 | 5/1903 | Hunter | 312/323 |
| 887,602 | 5/1908 | Dorey | 312/319 UX |
| 1,466,755 | 9/1923 | Reid et al. | 312/323 |
| 2,220,114 | 5/1940 | Peltier et al. | 312/291 X |
| 2,630,364 | 3/1953 | Gleason | 312/323 |
| 2,692,813 | 10/1954 | Toronto | 312/319 |
| 2,823,973 | 2/1958 | Carver et al. | 312/323 |
| 2,973,236 | 2/1961 | Hicks et al. | 312/319 |
| 3,212,835 | 10/1965 | Beckett et al. | 312/319 X |
| 3,271,092 | 9/1966 | Hatfield et al. | 312/319 X |
| 3,320,010 | 5/1967 | Ritzerfelo | 312/323 |
| 3,653,540 | 4/1972 | Offutt | 221/75 |
| 3,831,807 | 8/1974 | Deaton et al. | 221/85 |

FOREIGN PATENTS OR APPLICATIONS

| | | | |
|---|---|---|---|
| 6,571 | 3/1901 | United Kingdom | 312/323 |

*Primary Examiner*—Paul R. Gilliam
*Assistant Examiner*—Carl F. Pietruszka
*Attorney, Agent, or Firm*—Shenier & O'Connor

[57] ABSTRACT

A merchandising machine cabinet and shelf structure in which a pair of channel-shaped rails mounted on the inner sides of the cabinet structure at corresponding heights and extending from front to back of the cabinet with the channels opening inwardly receive respective pairs of spaced wheels mounted on the sides of the shelf to permit the shelf to be moved rectilinearly out of a fully housed home position to an intermediate position at which an element on the shelf engages a pivot adjacent to the front of the cabinet and at which one roller of each pair registers with a slot in the upper wall of the corresponding channel to permit the shelf to be pivoted downwardly to a limit position at which the merchandising units are readily accessible for loading. Interengageable means on the cabinet door and on the front of the shelf ensures that the shelf is moved fully into its home position as the door is closed.

3 Claims, 6 Drawing Figures

MERCHANDISING MACHINE CABINET AND SHELF STRUCTURE

This is a division of application Ser. No. 454,118, filed Mar. 25, 1974.

BACKGROUND OF THE INVENTION

Various forms of merchandising machines are known in the prior art. For example, there are known machines of the type in which a helix receiving articles between adjacent turns thereof is driven to advance the leading article over the edge of a shelf or the like to permit it to fall to a delivery area. Machines of this type may be provided with a multiplicity of such helices together with selectively operable means for driving the helices to deliver different articles. These machines are especially adapted to dispense light articles such as bagged snacks.

Machines of the prior art of the type described above incorporate a number of disadvantages. Machines of the type described above are difficult to load. Owing to the complexity of the helix itself, cleaning of the machines is difficult.

We have invented a versatile merchandising machine which overcomes the disadvantages of machines of the prior art pointed out hereinabove. Our machine is easy to load. The merchandise holding parts of our machine are readily disassembled for cleaning and readily reassembled.

SUMMARY OF THE INVENTION

One object of our invention is to provide a versatile merchandising machine which overcomes the defects of helical feed merchandising machines of the prior art.

A further object of our invention is to provide a versatile merchandising machine which is relatively easy to clean.

A still further object of our invention is to provide a versatile merchandising machine which is easy to load.

Other and further objects of our invention will appear from the following description.

In general, our invention contemplates the provision of a versatile merchandising machine including a plurality of delivery units supporting shelves arranged in the cabinet in superposed relationship. Each shelf is mounted for movement outwardly and pivotal movement downwardly through a limited arc to facilitate loading of the units of the shelf.

BRIEF DESCRIPTION OF THE DRAWINGS

In the accompanying drawings which form part of the instant specification and which are to be read in conjunction therewith and in which like reference numerals are used to indicate like parts in the various views:

FIG. 3 is a fragmentary sectional view of one of the shelves of the form of our versatile merchandising machine illustrated in FIG. 1.

DESCRIPTION OF THE PREFERRED EMBODIMENT

Figure 1:
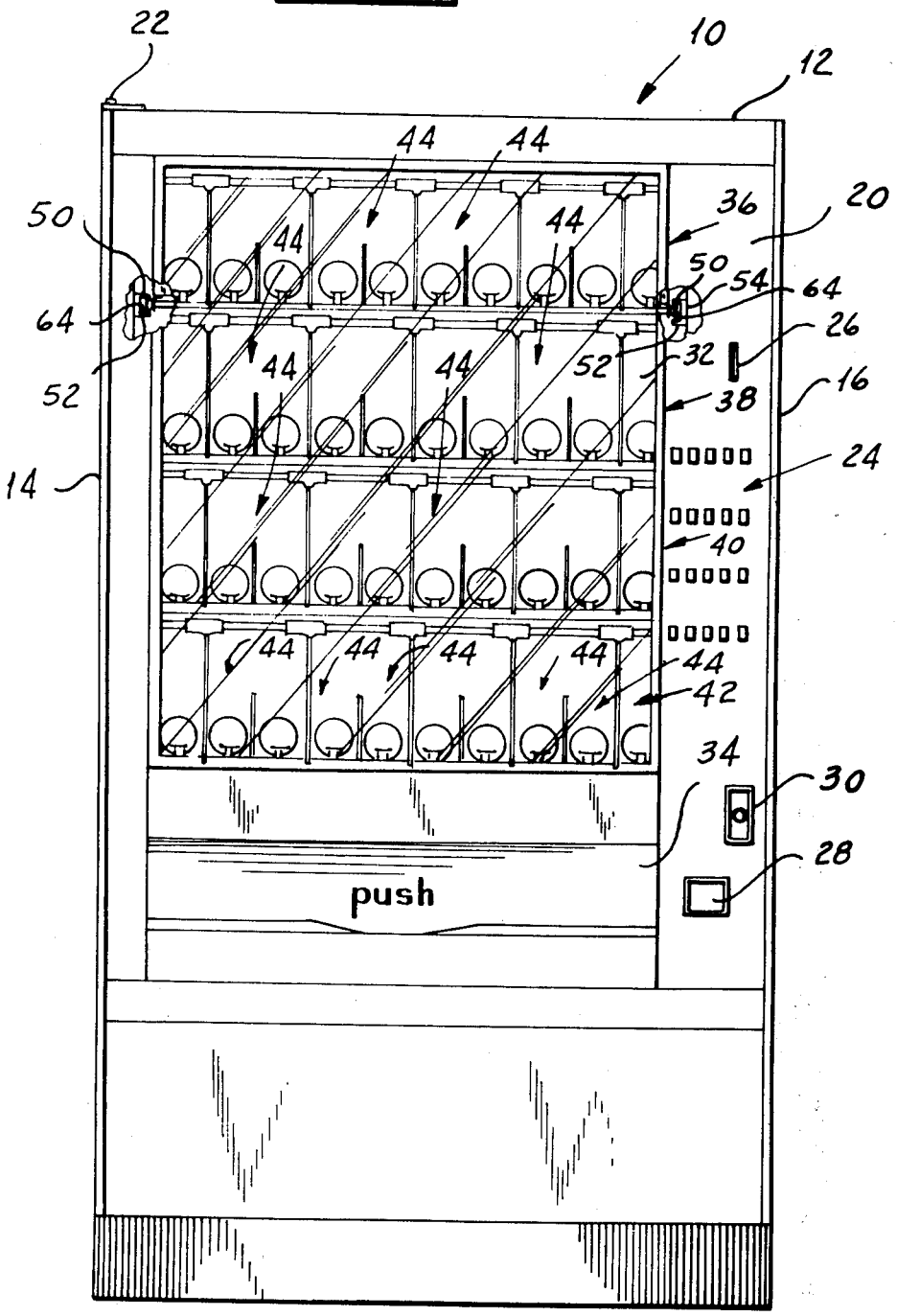
FIG. 1 is a front elevation of our versatile merchandising machine.
Figure 2:
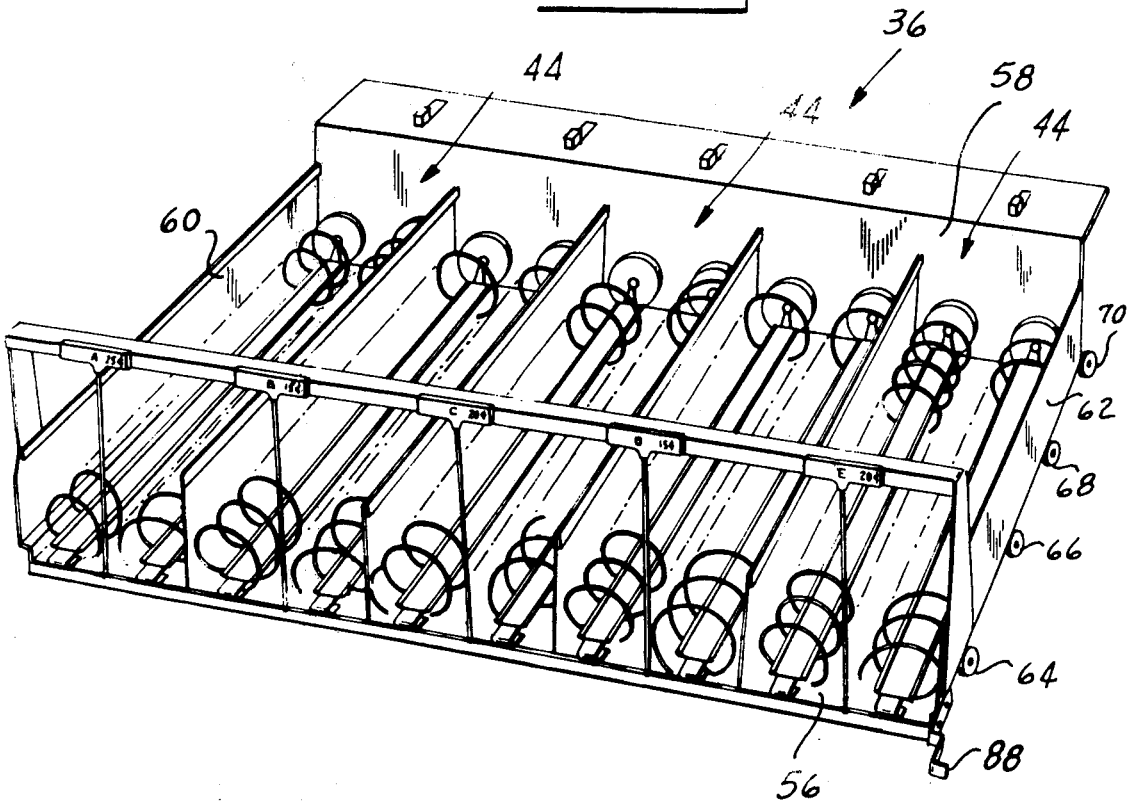
FIG. 2 is a perspective view of one of the shelves of the form of our versatile merchandising machine illustrated in FIG. 1.
Figure 5:
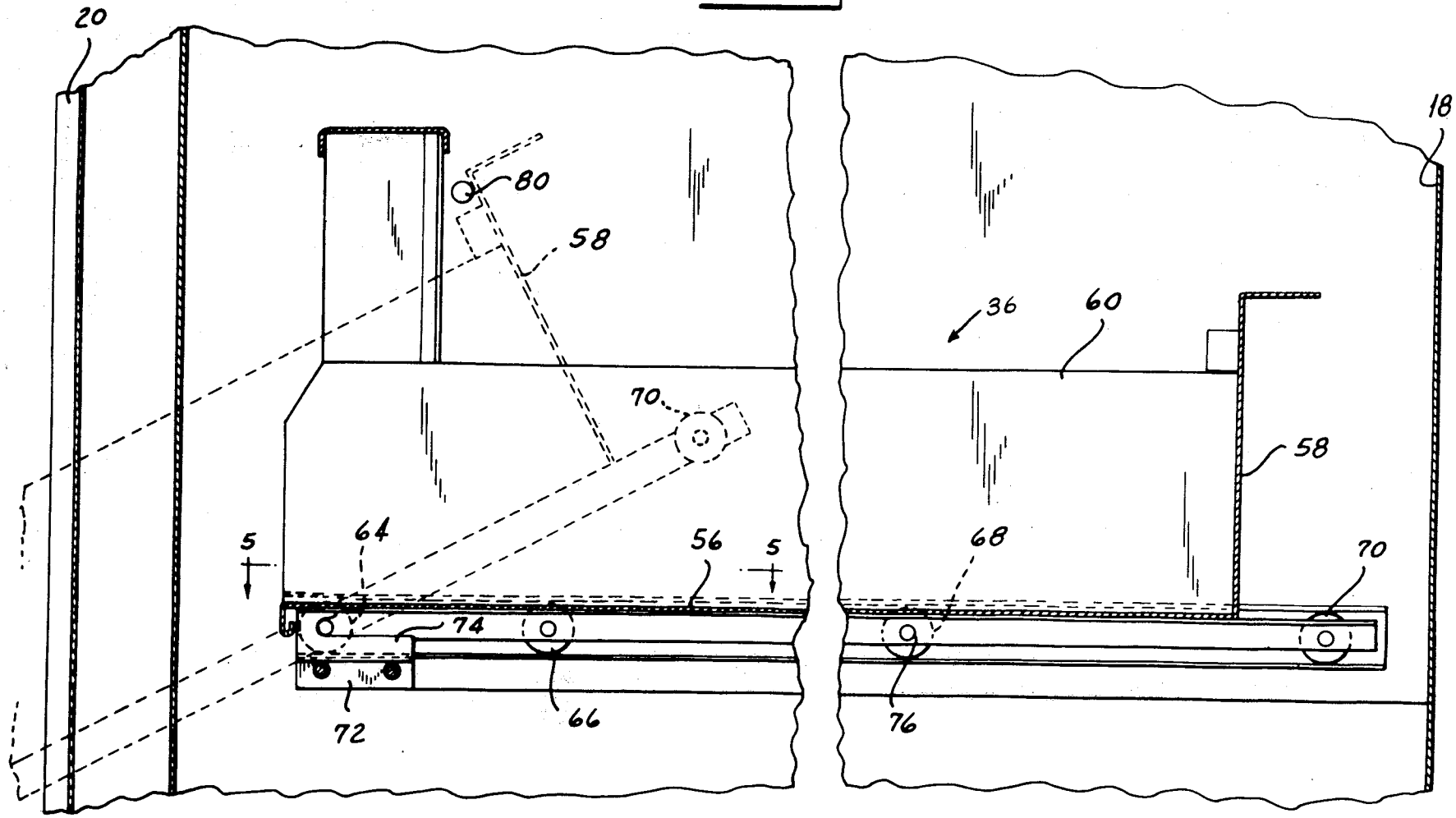
FIG. 5 is a fragmentary sectional view of one of the levels of our versatile merchandising machine.
Figure 4:
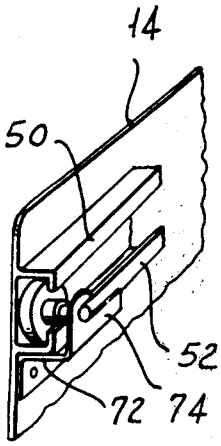
FIG. 4 is a fragmentary perspective view of one of the levels of our versatile merchandising machine.

Referring now to FIGS. 1 to 5 of the drawings our versatile merchandising machine, indicated generally by the reference character 10, includes a cabinet 12 having sides 14 and 16 and a back 18. The open front of the cabinet 12 is adapted to be closed by a door 20 carried by a hinge 22 on the cabinet. Door 20 supports an array 24 of push buttons, a coin slot forming member 26, a coin return tray 28 and a lock 30. A window 32 in the door 20 permits the customer to view articles to be dispensed. Door 20 also supports a delivery box assembly 34 through which a dispensed article is accessible to the customer.

While we may provide our machine 10 with any practical number of delivery levels, in the particular embodiment illustrated in the drawings we provide four levels indicated generally respectively by reference characters 36, 38, 40 and 42. Each of the levels 36, 38, 40 and 42 is made up of a plurality of delivery units indicated generally respectively by reference characters 44. Each unit 44 is of the type which is especially adapted to dispense articles such as bagged snacks or the like.

At each level on side 14 we mount a pair of upper and lower roller-track-forming rails 50 and 52. A partition 54 in the cabinet 12 carries pairs of rails 50 and 52 at locations corresponding to the locations of the pairs of rails 50 and 52 on side 14. Since all of the levels 36, 38 and 40 are substantially identical, we will described only the level 36 in detail. Level or shelf 36 includes a base 56, formed with a back panel 58 and provided with sides 60 and 62. We mount a plurality of spaced rollers 64, 66, 68 and 70 along the lower edge of each of the sides 60 and 62. Each set of the rollers 64, 66, 68 and 70 is adapted to be received in a pair of the rails 50 and 52 to mount the shelf 36 for rolling movement inwardly and outwardly of the cabinet 12.

We mount a respective pivot bracket 72 at the forward end of each of the rails 52 associated with the tray 36. We provide the supporting shaft of each roller 68 of the level with an inwardly directed extension 76 adapted to be received in a hook 74 on the associated bracket 72 when the shelf is rolled outwardly. When the shelf has been rolled outwardly to a position at which the extensions 76 engage in hooks 74 the rear rollers 70 are aligned with slots 78 in the upper rails 50 associated with the tray. From this position the tray can be pivoted downwardly around extensions 76 until the back panel 58 engages stop pins or rollers 80. In this position of the tray it is readily accessible to the servicemen for loading.

Figure 6:
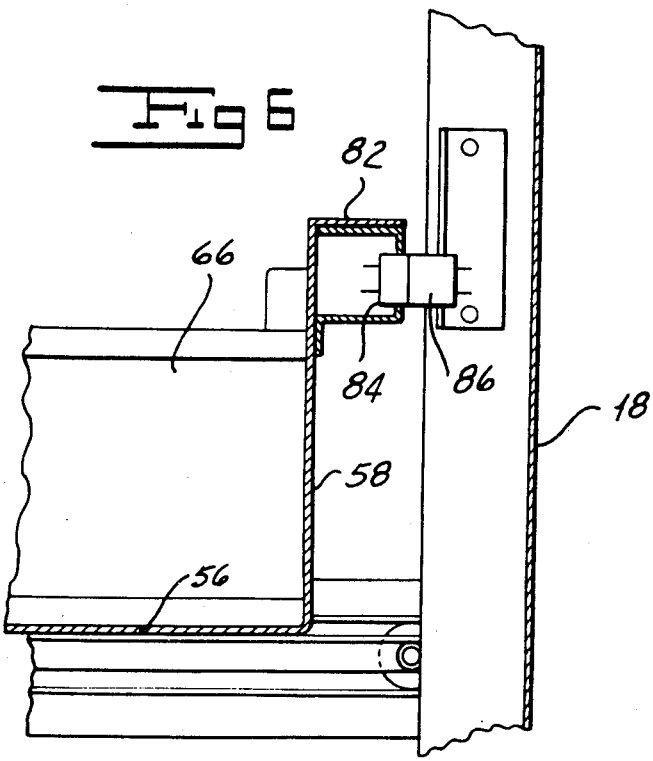
FIG. 6 is a fragmentary sectional view of one of the levels of our versatile merchandising machine illustrating the manner of making electrical circuit connections to a unit.
Figure 5:
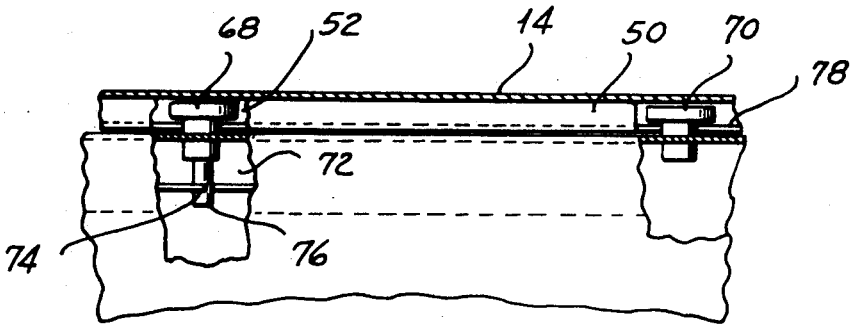

Referring to FIG. 6, back panel 58 carries a bracket 82 supporting a plug 84 adapted to be inserted into a receptacle 86 supported adjacent to the back 18 of the cabinet. As will more fully be pointed out hereinbelow, when a tray is slid outwardly for loading the plug 84 is disengaged from receptable 86. As the tray is slid back into its home position, plug 84 automatically engages in receptacle 86.

Referring again to FIG. 2, we mount a pusher foot 88 on each tray adjacent to the front at the right edge thereof as viewed from the front. In the event that a tray is not slid fully into its home position by the serviceman after he has loaded the tray, as the door closes it engages foot 88 to move the tray fully into its home position. This action serves to ensure re-establishment of the electrical connection provided by plug 84 and receptacle 86. In addition, it ensures that the forward edge of the tray is out of the path of articles falling from delivery units above.

When it is desired to load the machine, the shelf can be slid outwardly until the pin on the next to rear roller 68 engages the hook 74 at which time the rearmost roller 70 will be aligned with the slot 78. The shelf can then be pivoted until the back 58 of the shelf engages the stop pins or rollers 80. The machine can then be loaded. After loading the shelf is restored to its initial position and the electrical connection provided by plug 84 and receptacle 86 is re-established. If for any reason the shelf is not in a fully home position as the door is swung to a closed position it engages the foot 88 on the shelf to move it into a fully home position.

It will be seen that we have accomplished the objects of our invention. We have provided a versatile merchandising machine which overcomes the defects of helical feed machines of the prior art. Our machine is relatively easy to clean. It is simple to load.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. In a merchandising machine, apparatus including in combination, a cabinet having side walls, a shelf, and means mounting said shelf on said side walls for sequential limited generally horizontal rectilinear movement from a housed position in said cabinet to an intermediate position and for limited downward pivotal movement of the front edge of said shelf to a loading position of said shelf, said shelf mounting means comprising a channel-shaped guide rail, means mounting said guide rail on the inner surface of one of said cabinet sides with the channel thereof opening inwardly and with said rail extending from front to back of said cabinet, a pair of spaced rollers adapted to be received in the channel of said rail, means mounting one of said rollers on said shelf adjacent to the rear thereof, means mounting the other roller of said pair on said shelf at a location intermediate the front and back of said shelf; a pivot on said cabinet adjacent to the front thereof, an element on said shelf for engaging said pivot in said intermediate position of said shelf, and an opening in the upper wall of said channel-shaped guide at a location intermediate the ends thereof, the distance between said pivot and said opening being substantially equal to the distance between said element and said one roller whereby said one roller may move through said opening when said element engages said pivot to permit said shelf to move to said loading position, said other roller mounting means comprising a shaft, said pivot comprising a rearwardly opening hook, and said element comprising an extension on said shaft adapted to be received in said hook in the intermediate position of said shelf, an electrical plug on one of said shelf and cabinet, a receptacle on the other of said shelf and cabinet, said plug and receptacle being operatively engaged in the housed position of said shelf and disengaged when said shelf is out of its housed position, a door, means mounting said door on said cabinet for pivotal movement on one edge thereof between an open position and a closed position, and interengageable means on said door and on said shelf for moving said shelf to fully housed position in response to movement of said door to closed position to ensure engagement of said plug and receptacle.

2. Apparatus as in claim 1 in which said interengageable means comprises a forwardly extending foot on said shelf adjacent to the edge of said door remote from said pivoted edge.

3. In a merchandising machine, apparatus including in combination, a cabinet having side walls, a shelf, and means mounting said shelf on said side walls for sequential limited generally horizontal rectilinear movement from a housed position in said cabinet to an intermediate position and for limited downward pivotal movement of the front edge of said shelf to a loading position of said shelf, said shelf mounting means comprising a channel-shaped guide rail, means mounting said guide rail on the inner surface of one of said cabinet sides with the channel thereof opening inwardly and with said rail extending from front to back of said cabinet, a pair of spaced rollers adapted to be received in the channel of said rail, means mounting one of said rollers on said shelf adjacent to the rear thereof, means mounting the other roller of said pair of said shelf at a location intermediate the front and back of said shelf; a pivot on said cabinet adjacent to the front thereof, an element on said shelf for engaging said pivot in said intermediate position of said shelf, an opening in the upper wall of said channel-shaped guide at a location intermediate the ends thereof, the distance between said pivot and said opening being substantially equal to the distance between said element and said one roller whereby said one roller may move through said opening when said element engages said pivot to permit said shelf to move to said loading position, said shelf mounting means comprising a second channel-shaped guide rail, means mounting said second guide rail on the inner surface of the other cabinet side with the channel thereof opening inwardly and with the second rail extending from front to back of said cabinet, a second pair of spaced rollers adapted to be received in the channel of said second rail, means mounting one of the rollers of said second pair on said shelf adjacent to the rear thereof, means mounting the other roller of the second pair on said shelf at a location intermediate the ends thereof, a second pivot on said cabinet adjacent to the front thereof, a second element on said shelf for engaging said pivot in the intermediate position of said shelf, and a second opening in the upper wall of said second channel-shaped guide at a location intermediate the ends thereof, the distance between said second pivot and said second guide opening being substantially equal to the distance between said second element and said one roller of said second pair, an electrical plug on one of said shelf and cabinet, a receptacle on the other of said shelf and cabinet, said plug and receptacle being operatively engaged in the housed position of said shelf and disengaged when said shelf is out of its housed position, a door, means mounting said door on said cabinet for pivotal movement on one edge thereof between an open position and a closed position, and interengageable means on said door and on said shelf for moving said shelf to fully housed position in response to movement of said door to closed position to ensure engagement of said plug and receptacle, said interengageable means comprising a forwardly extending foot on said shelf adjacent to the edge of said door remote from said pivoted edge.

* * * * *